US010899100B2

(12) United States Patent
Kramer

(10) Patent No.: US 10,899,100 B2
(45) Date of Patent: Jan. 26, 2021

(54) POWDER PRESS AND A FEED HOUSING HAVING PREFERABLY A PLURALITY OF STAMPS WHICH ARE MOVABLE FOR A TRANSVERSE PRESS

(71) Applicant: Dietmar W Kramer, Auslikon (CH)

(72) Inventor: Dietmar W Kramer, Auslikon (CH)

( * ) Notice: Subject to any disclaimer, the term of this patent is extended or adjusted under 35 U.S.C. 154(b) by 155 days.

(21) Appl. No.: 15/555,138

(22) PCT Filed: Feb. 26, 2016

(86) PCT No.: PCT/EP2016/054121
§ 371 (c)(1),
(2) Date: Sep. 1, 2017

(87) PCT Pub. No.: WO2016/139151
PCT Pub. Date: Sep. 9, 2016

(65) Prior Publication Data

US 2018/0036982 A1 Feb. 8, 2018

(30) Foreign Application Priority Data

Mar. 5, 2015 (CH) ..... 312/15

(51) Int. Cl.
*B30B 11/00* (2006.01)
*B30B 15/06* (2006.01)
(Continued)

(52) U.S. Cl.
CPC ..... *B30B 11/007* (2013.01); *B22F 3/03* (2013.01); *B30B 11/004* (2013.01); *B30B 15/007* (2013.01); *B30B 15/065* (2013.01)

(58) Field of Classification Search
CPC ... B30B 11/007; B30B 11/004; B30B 15/007; B30B 15/065; B22F 3/03
(Continued)

(56) References Cited

U.S. PATENT DOCUMENTS 2,152,230 A * 3/1939 Webb ..... A61F 13/2051 28/120
2,263,909 A * 11/1941 Webb ..... A61F 13/2051 28/120
(Continued)

FOREIGN PATENT DOCUMENTS

CN 1974199 A * 6/2007 ..... B30B 1/40
CN 1974199 A 6/2007
(Continued)

OTHER PUBLICATIONS

Abstract of CN 1974199.
Abstract of EP 2441573.

*Primary Examiner* — Robert C Dye
*Assistant Examiner* — Guy F Mongelli
(74) *Attorney, Agent, or Firm* — Brian Roffe

(57) ABSTRACT

Powder press having preferably stamps which are movable for a transverse press in a feed housing. The stamps partially delimit a hollow chamber of a matrix in the feed housing and are able to be coupled to a press device by one connector piece each. An adjustable positioning device, which is formed from a wedge arrangement having a stop surface and placed crosswise to the moving direction of the stamp, is allocated to the respective stamp for determining the pressing position thereof. The wedge arrangement includes at least one wedge which is adjustable crosswise to the moving direction of the stamp and has the stop surface which contacts a stop surface at the stamp. Such a wedge arrangement can achieve very accurate pressing positions of the stamp, and extremely stable positioning of the stamp to be pressed with high pressure.

20 Claims, 4 Drawing Sheets

(51) Int. Cl.
*B22F 3/03* (2006.01)
*B30B 15/00* (2006.01)

(58) Field of Classification Search
USPC ..... 425/70
See application file for complete search history.

(56) References Cited

U.S. PATENT DOCUMENTS 3,259,941 A 7/1966 Yasunami
3,555,607 A * 1/1971 Epain et al. ..... B01J 3/067 425/77
3,555,621 A * 1/1971 Hara ..... B30B 11/007 425/3
3,671,164 A * 6/1972 Hara ..... B30B 11/02 425/414
3,758,245 A * 9/1973 Hermes ..... B22F 3/03 425/78
4,414,028 A * 11/1983 Inoue ..... B28B 3/086 419/31
7,429,049 B2 * 9/2008 Kramer ..... B23B 31/1071 279/2.03
7,641,827 B2 * 1/2010 Menzel ..... B22F 3/03 264/119
8,033,805 B2 * 10/2011 Gubanich ..... B22F 3/03 100/232
8,062,014 B2 * 11/2011 Gubanich ..... B22F 3/03 100/232
8,523,550 B2 9/2013 Wehrli et al.
9,138,954 B2 9/2015 Pannewitz et al.
9,149,875 B2 10/2015 Kramer
2005/0269729 A1 * 12/2005 Holthausen ..... B22F 3/03 264/109
2006/0222705 A1 * 10/2006 Flanner ..... A61J 3/10 424/464
2009/0136776 A1 * 5/2009 Gubanich ..... B22F 3/03 428/546
2009/0257905 A1 * 10/2009 Hartner ..... B22F 3/03 419/66
2010/0159051 A1 * 6/2010 Gubanich ..... B22F 3/03 425/78
2011/0027400 A1 * 2/2011 Wehrli ..... B22F 3/03 425/78
2013/0302456 A1 * 11/2013 Wehrli ..... B30B 11/02 425/78
2015/0024078 A1 * 1/2015 Pannewitz ..... B30B 11/04 425/78

FOREIGN PATENT DOCUMENTS

DE 1008421 B 5/1957
DE 1049084 B 1/1959
DE 1542241 A1 5/1970
DE 29500253 U1 * 5/1996 ..... B28B 3/086
DE 29500253 U1 5/1996
DE 102010033997 A1 * 2/2012 ..... B22F 3/02
DE 20 2013 100 211 * 5/2014
EP 2103423 A1 9/2009
EP 2441573 A1 4/2012
EP 2219811 B1 3/2016
FR 882344 A 5/1943
WO 2016139151 A1 9/2016

* cited by examiner

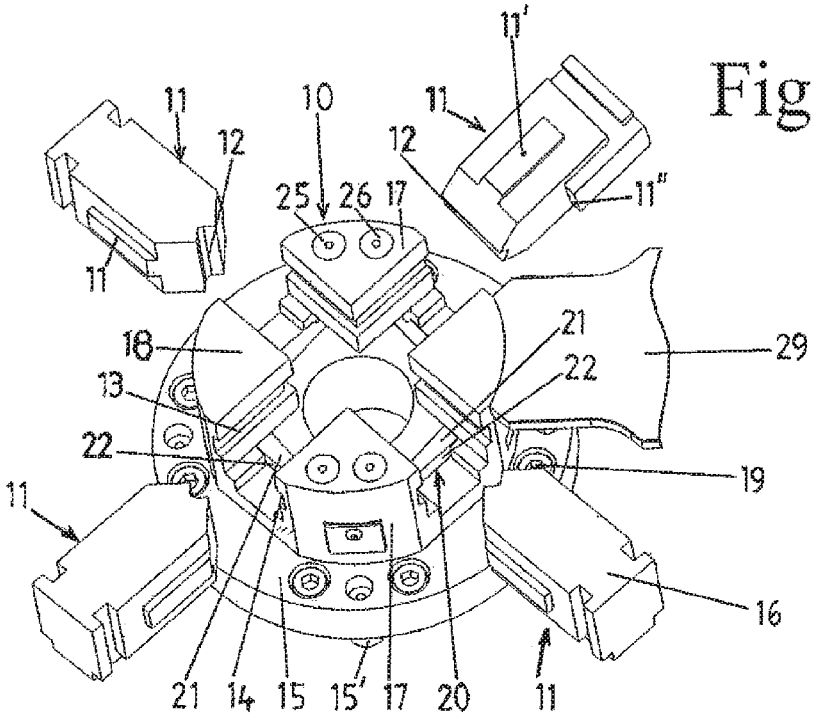
Fig. 1
Fig. 2
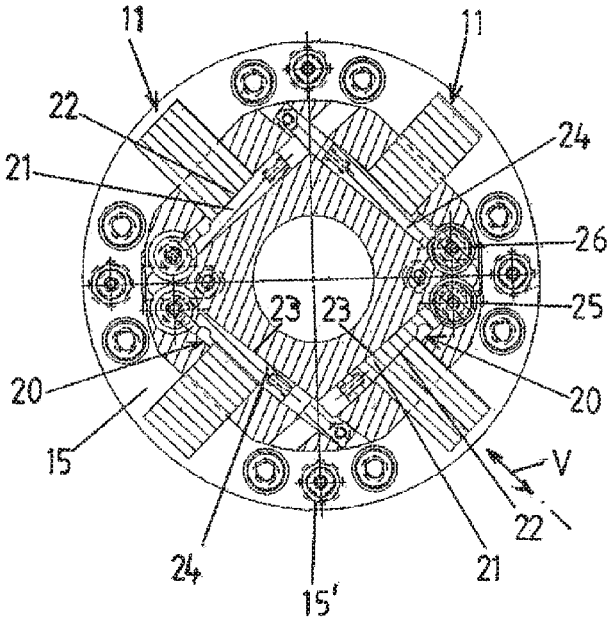
Fig. 3
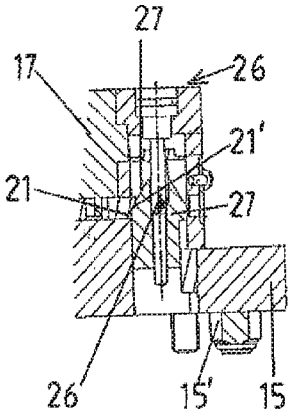

POWDER PRESS AND A FEED HOUSING HAVING PREFERABLY A PLURALITY OF STAMPS WHICH ARE MOVABLE FOR A TRANSVERSE PRESS

FIELD OF THE INVENTION

The invention relates to a powder press having a plurality of stamps movable for a transverse press in a feed housing, which stamps partially delimit a hollow chamber of a matrix in the feed housing, with an adjustable positioning means being allocated or assigned to the respective stamp for determining its pressing position, and being able to be coupled to a press device by a connector piece, and to a feed housing for a powder press wherein a plurality of stamps are provided for the transverse press, which stamps are collectively mounted such that they can be moved radially within the feed housing and in the center form part of a matrix with the hollow chamber for producing a pressed article.

BACKGROUND OF THE INVENTION

A powder press for the production of a pressed article according to publication EP-A-2 103 423 is provided with an upper and a lower stamp arrangement as well as a matrix arrangement which forms a mould cavity into which the powdered metal can be poured. Next, in order to mould the pressed article the stamp arrangements are pressed against one another in the direction of pressing. Moreover, transverse press devices are provided which are each connected to a transverse press stamp which can be pushed substantially crosswise into a pressing position through an opening in the matrix by means of a drive. The drive of each transverse press device is connected to a first wedge, the wedge surface of which acts on the surface of a second wedge which can be moved substantially at a right angle to the first wedge in the transverse pressing direction. In addition, an adjustable stop is provided as positioning means for determining the pressing position of a respective transverse pressing stamp. The latter is formed by a third wedge that can be adjusted crosswise to the moving direction of the first wedge. The first wedge strikes this third wedge as soon as the pressing position of the transverse press stamp is reached. It is a disadvantage here that this type of stop is not sufficiently stable with high pressing forces, and this position of the stamp may change inadvertently.

OBJECTS AND SUMMARY OF THE INVENTION

In contrast, it is the object of the present invention to improve a press device, in particular for the transverse pressing of a powder press, such that it guarantees very stable positioning of the transverse press stamp, even with very high pressing forces, and the pressing position of this transverse press stamp can additionally be adjusted easily and very accurately.

According to the invention, this object is achieved by the features of claim 1 and of claim 8.

The powder press according to the invention makes provision such that the positioning means are respectively formed from a wedge arrangement having a stop surface and placed crosswise to the moving direction of the stamp, this stop surface serving directly as a stop for the stamp or as a stop for the extension piece coupled to the latter.

With this type of wedge arrangement one can on the one hand achieve very accurate pressing positions of these stamps, and on the other hand this arrangement enables exceptionally stable positioning of the stamps that are to be pressed with high pressures.

Advantageously, the wedge arrangements are formed with wedge surfaces which have an angle of a few angular degrees in relation to their longitudinal extension so that this wedge arrangement is in the self-inhibiting range. This enables the stops to permanently remain securely in position as desired for these stamp positionings which are to be implemented numerous times.

With the feed housing according to the invention a positioning means is assigned to each stamp, which means is respectively stored in the feed housing and is formed from a wedge arrangement having a stop surface placed crosswise to the moving direction of the stamp.

The feed housing with the stamps and the wedge arrangements can thus be produced as one unit, by means of which the desired accurate pressing positions can be achieved optimally by simple handling.

BRIEF DESCRIPTION OF THE DRAWINGS

Exemplary embodiments of the invention and further advantages are explained in more detail below by means of drawings. These show as follows:

FIG. 1 is a perspective view of a feed housing of a powder press according to the invention, wherein the press stamps are shown in exploded form, one being shown rotated about 90° in order to give a better illustration;

FIG. 2 is a section through the feed housing according to FIG. 1 with an illustration of wedge arrangements;

FIG. 3 is a vertical partial section through an adjusting means in the feed housing according to FIG. 2;

DETAILED DESCRIPTION OF THE INVENTION

Figure 4:
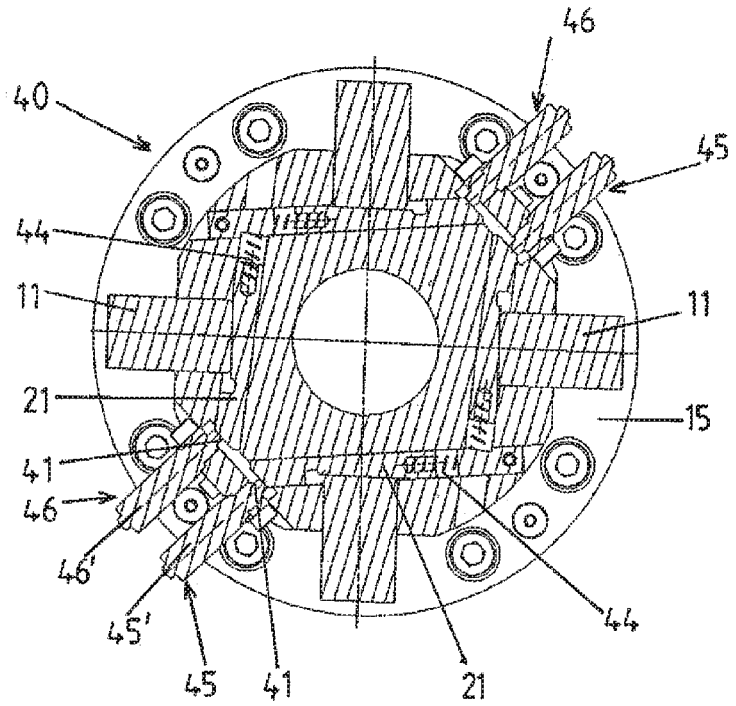
FIG. 4 is a section through a feed housing according to the invention, wherein, as a variant, the stamps and the adjusting means are arranged more or less radially.

A feed housing 10 of a powder press according to FIG. 1 and FIG. 2 consists of a base plate 15, guide blocks 17, 18 and of four stamps 11 provided for a transverse press and which can be inserted radially into sliding tracks 13, 14 of the guide blocks 17, 18 with their lateral guide elements 11', and in the center form part of a matrix with the hollow chamber for the production of a pressed article. For this purpose, corresponding recesses 12 are formed on the front side of the stamps 11 as a negative mould for the pressed article. On the rear side, the stamps 11 are each provided with a T-shaped coupling part 16 which can be coupled to a connector piece of a press device 49 according to FIG. 5.

In addition, a stamp that can be engaged from above and a stamp that can be engaged from below are provided on the press, but these are not detailed. On its lower side, the base plate 15 has centering pins 15' and can be appropriately centered on a press structure and be fixed by screws 19.

With this type of powder press, pressed articles in particular are produced in the conventional manner. In this connection, the powder is delivered into the matrix located in the center on a plate element 29 that projects away laterally on the feed housing 10. After pressing, the pressed articles are, for example, sintered, and used as cutting plates for tools.

According to the invention positioning means are respectively formed from a wedge arrangement 20 with a stop surface 22 placed crosswise to the moving direction of the stamp 11, this stop surface 22 serving directly as a stop for the stamp 11, as illustrated by FIG. 2.

The respective wedge arrangement 20 comprises a wedge 21 that can be adjusted crosswise to the moving direction of the stamp 11 and which has the stop surface 22 in the form of a wedge surface which can be brought into contact with a stop surface 11" of the stamp 11, as shown on the stamp 11 at the top right of FIG. 1. An inherent property of a wedge is that it is thicker at one end than at an opposite end, and thus has a variable thickness. The wedge 21 is guided here in the base plate 15 and its wedge surface is at an angle of several angular degrees in relation to its longitudinal extension so that this wedge arrangement 20 is within the self-inhibiting range upon pressing the stamp 11, the angle of several degrees of the wedge surface causing the difference in thickness of the wedge 21. Lying opposite the wedge surface or the stop surface 22 there is provided a guide surface 23 of the wedge 21 resting against an outer surface 24 of the base plate 15, which guide surface runs at right angles to its direction of adjustment.

This wedge arrangement 20 is also characterised in that these outer surfaces 24 of the base plate 15 do not run at right angles in relation to the radially moveable stamps 11, but at the same angle as the wedges. This results in the additional advantage that the stop surfaces 22 of the wedges 21, and so the stop surfaces 11" of the stamp 11 run at right angles to the direction of adjustment of the stamps 11, and so transverse forces are prevented from acting on the stamp or on the base plate 15 in the pressing position, and only these forces acting on the pressed article in the moving direction are transmitted.

Advantageously, an adjusting means 25, 26 connected to the respective wedge arrangement 20 is provided for determining the pressing position of the respective stamp 11, which adjusting means may be a micrometer screw, a fine-adjustment screw or the like. Two adjusting means 25, 26 are respectively integrated into a guide block 17 parallel to the longitudinal axis of the feed housing 10. The other two guide blocks 18 are, however, made without these means. With this vertical arrangement of the adjusting means 25, 26 the latter can easily be operated manually from the upper side of the feed housing 10. A compression spring (not detailed) causes the wedge 21 to press constantly against the adjusting means.

FIG. 3 shows an adjusting means 26 in section, and the interaction of the latter with the corresponding wedge 21. This adjusting means 26 comprises an operable screw 26' and a sliding nut 27 that can be height-adjusted by the latter in the guide block 17 and having an inclined surface 26'. The latter is in sliding contact with an inclined narrow side 21' of the wedge 21. Upon adjusting the screw 26' the wedge 21 is moved at right angles to the screw in its longitudinal extension, and so the pressing position of the stamp 11 is determined.

A feed housing 40 according to FIG. 4 is in itself configured in the same way as that according to FIG. 1 and FIG. 2. Therefore, in the following, only the differences will be described in detail. In particular, adjusting means 45, 46 for determining the pressing position are not arranged vertically, but more or less radially outwards within the feed housing 15. Their screws 45', 46' are respectively positioned with their front surface against an inclined narrow side 41 of the wedge 21 and bring about movement of the wedge 21 in its longitudinal direction when turned, the wedge 21 lying opposite being acted upon by a compression spring 44 so that it constantly rests against the screw 45', 46'.

From a certain size of the feed housing 10 these adjusting means 45, 46 could also be arranged more or less tangentially instead of more or less radially, and thereby be aligned in the longitudinal extension of the wedges 21. The advantage of this would be that 1:1 transmission would be brought about by adjusting the screws 45', 46', and no translation would have to be taken into account.

Figure 5:
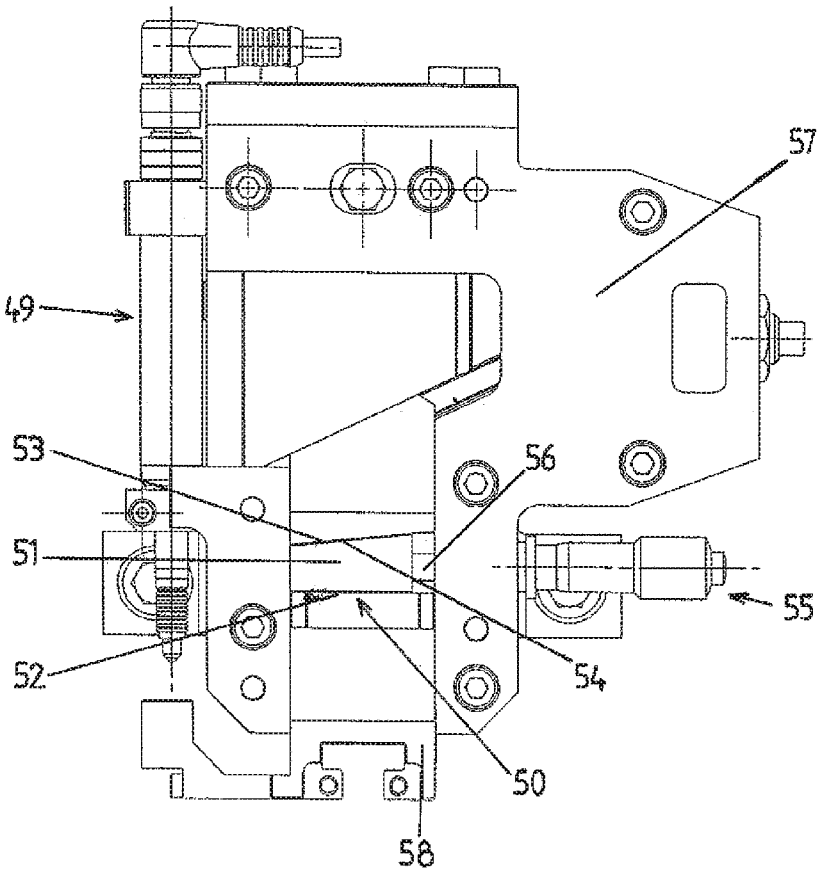
FIG. 5 is a top view of a press device of a powder press according to the invention, wherein the wedge arrangement is provided with the stamp on the connector piece.

FIG. 5 shows a press device 49 which is conventional in itself, and which is not displayed in full detail. With the latter, by means of a hydraulic drive that is indicated, and by means of a wedge system connected to the latter within a housing 57, a connector piece 58, and consequently a stamp 11 that can be coupled to the latter within the feed housing 10, can be operated with a pre-defined contact pressure.

According to the invention, in this press device 49 a positioning means is respectively formed from a wedge arrangement 50 with a stop surface 53 placed crosswise to the moving direction of the connector piece 58 or of the stamp 11, this stop surface 53 serving as a stop for the extension piece 58 and so for the stamp 11.

This wedge arrangement 50 comprises a wedge 51 with the stop surface 53 as a wedge surface which rests against an inclined surface 54 formed on the connector piece 58. An adjusting means 55 connected to the wedge 51 can be operated by a screw 56 such that the wedge 51 can be moved along its sliding surface 52, and so in turn the pressing position of the stamp can be adjusted. A micrometer screw which enables positioning of the stamp in the micrometer range is used here as the adjusting means 55.

Figure 6:
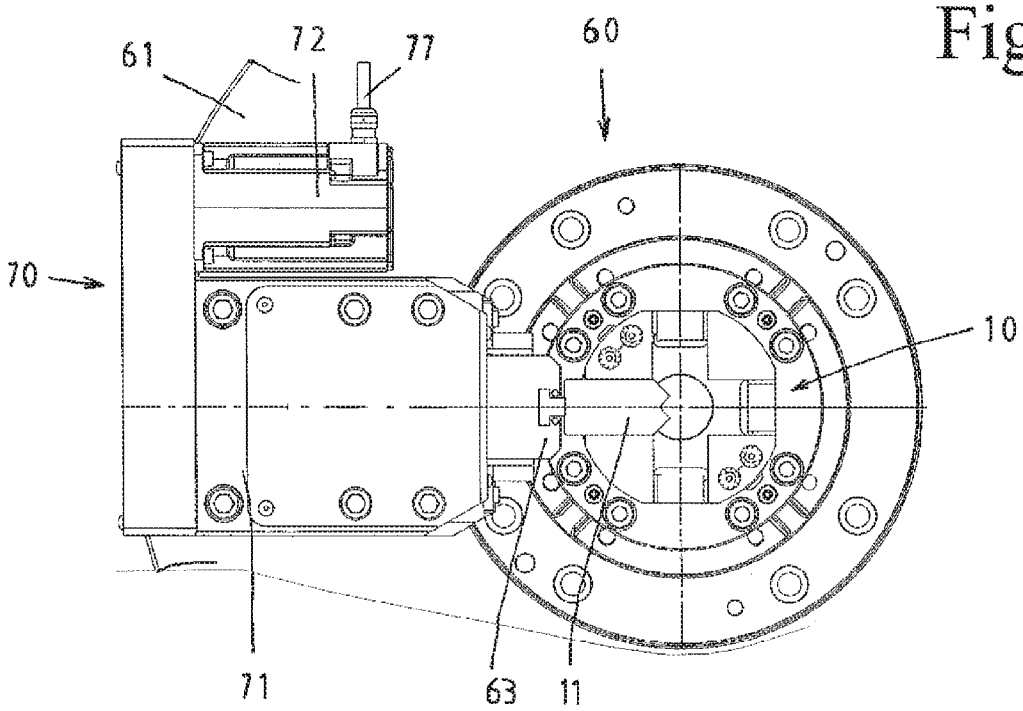
FIG. 6 is a top view of a powder press with a feed housing according to the invention and one of the four press devices to be used.

FIG. 6 shows a powder press 60 with the feed housing 10 according to the invention for four stamps and press devices assigned to the latter, of which only one stamp 11, however, and one press device 70, lying on the outside and coupled to the latter, is illustrated. These press devices are mounted here on a round base plate 61 that is indicated. A conveyor element projecting away to the side (not detailed) is provided by means of which the powder can be delivered to the hollow chamber of a matrix located in the centre.

Due to the compact design of these press devices 70, depending on the matrix from two to six of these could be arranged around a feed housing provided with a similar size to that according to FIG. 6.

This stamp 11 is coupled to a connector piece 63 of the press device 70 on the rear side turned away from the matrix by this T-shaped coupling part 16, delimiting the hollow chamber at the front. In addition, on the front side the stamp 11 is angled on both sides by an angle of 45° so that, as shown, in the pressing position the hollow chamber is completely enclosed. Depending on the number of stamps and the geometric form of the pressed article this angle can be appropriately adapted so that it is guaranteed that the stamps are extensively in contact with one another at the front.

The stamps 11 are pressed by the respective press device 70 against a stop surface according to the invention in the feed housing 10, i.e., each stamp 11 is moved from a position not in contact with the stop surface in a direction toward a center area of the matrix to a position in contact with the stop surface, so that during the entire pressing process the dimensions of this hollow chamber of the matrix remain very precisely within the accuracy range of preferably one micrometer.

The four preferably identically formed press devices 70 are arranged at 90° relative to one another on the outside of the feed housing 10 according to the alignment of the stamps 11. They each consist of a linear drive 75, a housing 71 surrounding the latter, a connector piece 63 respectively coupled to a stamp 11, and of an electric motor 72 with cable connections 73 serving as a drive unit of the press.

Figure 7:
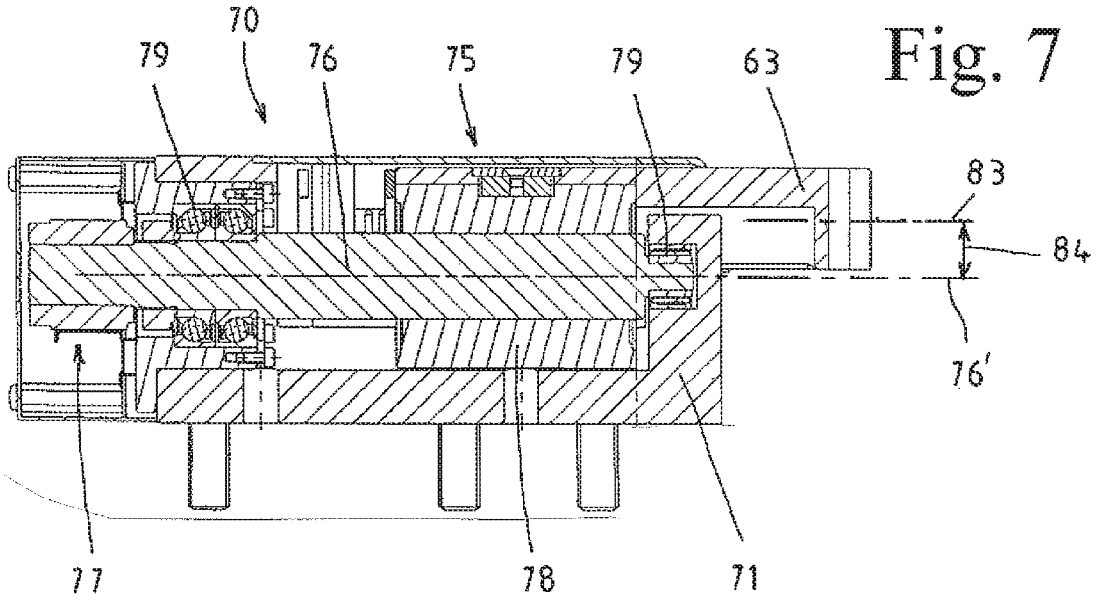
FIG. 7 is a section through the press device according to FIG. 6.

FIG. 7 shows a section through the press device 70 shown on the left-hand side in FIG. 6. According to the invention a planetary roller screw drive or a roller screw drive which is provided with a centric threaded spindle 76 and with a plurality of planetary rollers 78 rotatably mounted in the latter by means of receiving bodies provided on a spindle nut is used for the linear drive 75 of the respective press device 70. The threaded spindle 76 held rotatably in rolling bearings 79 in the housing 71 is rotatably connected to the electric motor 72 by a transmission means 77, whereas the spindle nut is fastened to the connector piece 63 that can be moved in the axial direction of the threaded spindle 76. Such planetary roller screw drives or roller screw drives are known in their own right. Therefore, not all of the details of the transmission structure are displayed.

Upon engaging and pressing the stamps 11 in the operating state, the connector piece 63 respectively coupled to the latter is moved together with the spindle nut and the planetary rollers 78 by the rotating threaded spindle 76 in the pressing direction of the stamp 11.

As a further advantage of this press device 70 provision is made such that an offset 84 is provided between the axis 76' of the threaded spindle 76 or of the spindle nut surrounding the latter concentrically and the axis of movement 83 of the connector piece 63 coupled to the latter.

Figure 8:
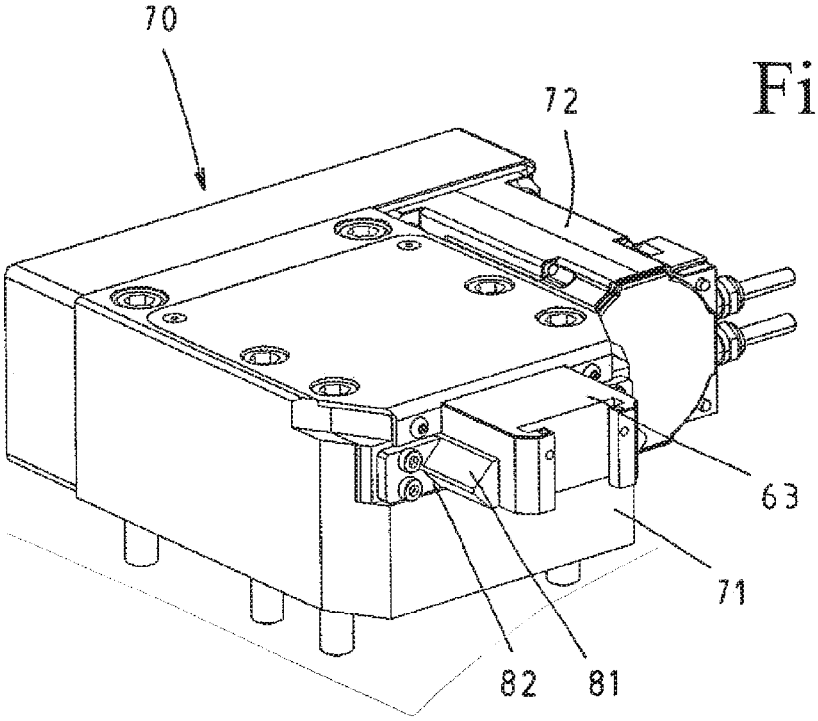
FIG. 8 is a perspective view of the press device according to FIG. 7.

FIG. 8 also illustrates the longitudinal guidance of the connector piece 63 within the housing 71 with which a guide carriage 81 connected to the spindle nut can be moved in guide tracks 82 within the housing 71. By means of said offset 84 of the movement axis of the connector piece 63 relative to the axis of the spindle nut, the width of this guide carriage 81 for the connector piece between the guide tracks 81 can be kept narrower and shorter than when the latter is located at the axial height of the spindle nut.

Within the framework of the invention these press devices 70 could each be equipped with a wedge arrangement in the same way as the one shown in FIG. 5.

The invention is sufficiently displayed by the above exemplary embodiments. However, it could also be realised by other variants. Thus, in the wedge arrangement two wedges 21 that can be adjusted relative to one another could also be provided. Thus, the stop surfaces 24 of the base plate 15 corresponding to the latter could be arranged at right angles.

In theory this wedge arrangement could be placed not below, but to the side of the stamp, and it could also be adjusted without an adjusting means in just one specific position if, for example, the same pressed articles are always produced.

The invention is of course also suitable when using just one stamp, which may be necessary depending on the requirement for the pressed article.

In principle, for the press device 70, instead of the described planetary roller screw drive or roller screw drive, an equivalent other gearing mechanism could be provided as the linear drive, by means of which high energy density can be generated with a small amount of space. In addition, two such linear drives could also be arranged next to one another for the pressing of a stamp.

The wedges are preferably each at an angle of a few angular degrees so that upon pressing the stamp this wedge arrangement is within the self-inhibiting range. Depending on the requirement the wedges could also be formed with a larger angle of inclination in the non-self-inhibiting range.

The invention claimed is:

1. A powder press, comprising:

a feed housing;

a movable stamp partially delimiting a hollow chamber of a matrix in said feed housing that is receivable of powder, said stamp being movable relative to said feed housing and configured to be coupleable to a press device, said stamp being movable by the press device in a radial direction toward a center area of the matrix to press powder when present in said chamber and form a powder-pressed article, said stamp including a stop surface facing said chamber and which is moved in the radial direction to different positions relative to said chamber; and a movable wedge having a stop surface situated between a portion of said stamp and said chamber, said wedge being arranged on said feed housing such that said stamp moves relative to said wedge, said wedge having a longitudinal extension and a wedge surface at an angle in relation to said longitudinal extension such that a thickness of said wedge varies from a first location along the longitudinal extension to a second location along the longitudinal extension spaced apart from the first location, said wedge being movable in a direction of its longitudinal extension and being positioned relative to said stamp such that movement of said wedge in the direction of its longitudinal extension is crosswise to the radial direction in which said stamp is movable and causes a change in the thickness of part of said wedge that is between said stop surface of said stamp and said chamber, said stop surface of said wedge facing said stop surface of said stamp and serving as a stop for movement of said stamp in the radial direction toward the center area of the matrix such that said stamp is movable by the press device to determine a pressing position of said stamp during pressing.

2. The powder press of claim 1, wherein said stop surface of said stamp is configured to be brought into contact with said stop surface of said wedge when the press device moves said stamp in the radial direction toward the center area of the matrix.

3. The powder press of claim 2, wherein said feed housing comprises a base plate for supporting said wedge and relative to which said stamp is movable, said base plate including a surface in sliding contact with a guide surface of said wedge which is not perpendicular to the moving direction of said stamp and is at a common angle as an angle of said wedge so that said stop surface of said wedge or said stop surface of said stamp is perpendicular to the radial direction in which said stamp is movable, said guide surface of said wedge being on an opposite side of said wedge from said stop surface of said wedge.

4. The powder press of claim 1, further comprising adjusting means connected to said wedge for adjusting a position of said wedge relative to said stop surface of said stamp by moving said wedge in the direction of its longitudinal extension to cause the change in the thickness of the part of said wedge between said stop surface of said stamp and said chamber and thereby cause adjustment of the pressing position of said stamp.

5. The powder press of claim 4, wherein said adjusting means comprise a micrometer screw or an adjustment screw.

6. The powder press of claim 4, wherein said adjusting means are aligned parallel to a longitudinal axis of said feed housing or inward toward a central region of said feed housing.

7. The powder press of claim 4, wherein said adjusting means are configured to be operated manually from a position outside of said powder press.

8. The powder press of claim 1, wherein said stamp has side surfaces between a front side and a rear side, and said wedge is situated alongside one of said side surfaces of said stamp, said stamp further comprising two guide elements each on a different one of said side surfaces of said stamp and said guide elements being on opposite side surfaces of said stamp, the powder press further comprising guide blocks on said feed housing having two sliding tracks that each cooperate with a respective one of said two guide elements of said stamp to guide movement of said stamp in the radial direction.

9. The powder press of claim 1, wherein said stamp includes a recess formed on a front side of said stamp and a coupling part on a rear side, said stop surface of said wedge being in a position between said recess and said coupling part, the powder press further comprising a connector piece which is a part of the press device and couples to said coupling part of said stamp to enable the press device to move said stamp in the radial direction.

10. The powder press of claim 1, wherein said stop surface of said wedge serves directly as the stop for movement of said stamp in the radial direction toward the center area of the matrix such that said stamp is movable from a position not in contact with said stop surface of said wedge into a position in contact with said stop surface of said wedge by the press device to determine the pressing position of said stamp during pressing.

11. A powder press, comprising:

a feed housing;

a plurality of movable stamps each delimiting a respective part of a hollow chamber of a matrix in said feed housing that is receivable of powder, said stamps being configured to be coupleable to at least one press device, said stamps being movable relative to said feed housing, each of said stamps being movable by the at least one press device in a radial direction toward a center area of the matrix to press powder when present in said chamber and form a powder-pressed article, each of said stamps including a stop surface facing said chamber and which is moved in the radial direction to different positions relative to said chamber; and a plurality of movable wedges equal in number to a number of said stamps, each of said wedges being associated with a respective one of said stamps and having a stop surface situated between a portion of the respective one of said stamps and said chamber, said wedges being arranged on said feed housing such that each of said stamps moves relative to a respective one of said wedges, each of said wedges having a longitudinal extension and a wedge surface at an angle in relation to said longitudinal extension such that a thickness of said wedge varies from a first location along the longitudinal extension to a second location along the longitudinal extension spaced apart from the first location, each of said wedges being movable in a direction of its longitudinal extension and being positioned relative to a respective one of said stamps such that movement of said wedge in the direction of its longitudinal extension is crosswise to the radial direction in which the respective one of said stamps is movable and causes a change in the thickness of part of said wedge that is between said stop surface of said stamp and said chamber, said stop surface of each of said wedges facing said stop surface of the respective one of said stamps and serving as a stop for movement of the respective one of said stamps in the radial direction toward the center area of the matrix such that said stamp is movable by the at least one press device to determine a pressing position of said stamp during pressing.

12. The powder press of claim 11, wherein each of said stamps has side surfaces between a front side and a rear side, and the respective one of said wedges is situated alongside one of said side surfaces of each of said stamps, each of said stamps further comprising guide elements on opposite ones of said side surfaces of said stamp and other than the side surface alongside which the respective one of said wedges is situated, said guide elements being on opposite side surfaces of each of said stamps, the powder press further comprising guide blocks on said feed housing having sliding tracks that each cooperate with a respective one of said guide elements of said stamps to guide movement of said stamps in the radial direction.

13. The powder press of claim 11, wherein each of said stamps includes a recess formed on a front side of said stamp and a coupling part on a rear side, said stop surface of each of said wedges being in a position between said recess and said coupling part of the respective one of said stamps, the powder press further comprising connector pieces which are a part of the at least one press device and each of which couples to said coupling part of a respective one of said stamps to enable the at least one press device to move said stamps in the radial direction.

14. The powder press of claim 11, wherein said stop surface of each of said wedges serves directly as the stop for movement of the respective one of said stamps in the radial direction toward the center area of the matrix such that said stamp is movable from a position not in contact with said stop surface of said wedge into a position in contact with said stop surface of said wedge by the at least one press device to determine the pressing position of said stamp during pressing.

15. A feed housing, comprising:

a base plate;

a plurality of movable stamps each movable in a radial direction and which in a center of said feed housing collectively define a hollow chamber for producing a pressed article, said stamps being movable relative to said base plate, each of said stamps including a stop surface facing said chamber and which is moved in the radial direction to different positions relative to said chamber; and a plurality of movable wedges equal in number to a number of said stamps, said wedges being mounted within said feed housing and guided in movement by said base plate such that each of said stamps moves relative to a respective one of said wedges, each of said wedges having a stop surface situated between a portion of the respective one of said stamps and said chamber and that serves as a stop for the respective one of said stamps, said stop surface of each of said stamps facing said stop surface of the respective one of said wedges, each of said wedges having a longitudinal extension and a wedge surface at an angle in relation to said longitudinal extension such that a thickness of said wedge varies from a first location along the longitudinal extension to a second location along the longitudinal extension spaced apart from the first location, each of said wedges being movable in a direction of its longitudinal extension and being positioned relative to a respective one of said stamps such that movement of said wedge in the direction of its longitudinal extension is crosswise to the radial direction in which said stamp is movable and causes a change in the thickness of part of said wedge that is between said stop surface of said stamp and said chamber.

16. The feed housing of claim 15, further comprising respective adjusting means connected to each of said wedges for adjusting said wedge relative to said stop surface of the respective one of said stamps by moving said wedge in the direction of its longitudinal extension to cause the change in the thickness of the part of said wedge between said stop surface of the respective one of said stamps and said chamber and thereby adjust the pressing position of the respective one of said stamps provided by said wedge.

17. The feed housing of claim 16, wherein said adjusting means comprise a micrometer screw or an adjustment screw.

18. The feed housing of claim 15, wherein each of said stamps has side surfaces between a front side and a rear side, and the respective one of said wedges is situated alongside one of said side surfaces of each of said stamps, each of said stamps further comprising guide elements on opposite ones of said side surfaces of said stamp and other than the side surface alongside which the respective one of said wedges is situated, said guide elements being on opposite side surfaces of each of said stamps, the powder press further comprising guide blocks on said base plate having sliding tracks that each cooperate with a respective one of said guide elements of said stamps to guide movement of said stamps in the radial direction.

19. The feed housing of claim 15, wherein said wedges are guided in said base plate and each of said stamps includes a recess formed on a front side of said stamp and a coupling part on a rear side, said stamps being coupleable to a press device via said coupling part, said stop surface of each of said wedges being in a position between said recess and said coupling part of the respective one of said stamps.

20. The feed housing of claim 19, wherein said stop surface of each of said wedges serves directly as the stop for movement of the respective one of said stamps in the radial direction toward the center area of the matrix such that said stamp is movable from a position not in contact with said stop surface of said wedge into a position in contact with said stop surface of said wedge by the press device to determine a pressing position of said stamp during pressing.

* * * * *